United States Patent [19]

Helle

[11] Patent Number: 4,691,479

[45] Date of Patent: Sep. 8, 1987

[54] MACHINE AND PROCESS FOR CUTTING CHIPPING-GROOVES INTO ELONGATED PERIPHERAL MILLING CUTTERS WITH HEMISPHERICAL TIPS

[75] Inventor: Hans-Joachim Helle, Tübingen, Fed. Rep. of Germany

[73] Assignee: Montanwerke Walter GmbH, Tübingen, Fed. Rep. of Germany

[21] Appl. No.: 865,043

[22] Filed: May 19, 1986

[30] Foreign Application Priority Data

Jun. 7, 1985 [DE] Fed. Rep. of Germany ..... 3520521

[51] Int. Cl.[4] ..... B24B 3/02

[52] U.S. Cl. ..... 51/165.71; 51/225; 51/288

[58] Field of Search ..... 51/165.71, 165 TP, 288, 51/225

[56] References Cited

U.S. PATENT DOCUMENTS

| | | | |
|---|---|---|---|
| 3,680,263 | 8/1972 | Johnson | 51/288 |
| 4,550,532 | 11/1985 | Fletcher | 51/165.71 |
| 4,619,079 | 10/1986 | Kidani | 51/165.71 |

OTHER PUBLICATIONS

Technical Conference of the Numerical Control Society, 22–24, Mar. 1971, Proceedings of 8th Annual Meeting, "Numerically Controlled Gringing", W. D. Hughes, pp. 288–296, Anahiem Calif.

*Primary Examiner*—Harold D. Whitehead

*Attorney, Agent, or Firm*—Frishauf, Holtz, Goodman & Woodward

[57] ABSTRACT

A clamping device is mounted to the machine bed of a grinding machine and is longitudinally slideable along said machine bed. Adjacent to the machine bed a rotatably driven grinding wheel is arranged such that by means of several actuators relative movements are possible between workpiece and tool in an X-Y-Z coordinate system related to the workpiece, while the grinding wheel is slideable parallel to its rotational axis which is adjusted according to the pivoting angle. To achieve a smooth transition without a ridge between the shaft portion and the hemispherical portion of the workpiece, the grinding wheel is moved, without interrupting its path curve such that the rotational axis describes roughly the arc of a circle about the hemispheric end. Simultaneously the grinding wheel performs a translatory movement parallel to its rotational axis such that the cutting edge in the hemispherical portion runs at a positive rake in the direction of the longitudinal axis of the workpiece.

13 Claims, 5 Drawing Figures

MACHINE AND PROCESS FOR CUTTING CHIPPING-GROOVES INTO ELONGATED PERIPHERAL MILLING CUTTERS WITH HEMISPHERICAL TIPS

The invention relates to a machine and process for cutting chipping-grooves into elongated peripheral cutting tools such as peripheral milling cutters, die milling cutters, etc., which taper hemispherically at their cutting end, particularly a grinding machine.

BACKGROUND

Grinding machines whose tools and/or grinding wheels are movable about several theoretical axes are known in practice. When a peripheral milling cutter has to be ground with such grinding machines, the customary procedure is to first cut a continuous chipping-groove in the shaft portion , and then—after disengaging the grinding wheel—to cut the chipping-groove in the hemispherical end by means of successive plunging cuts. This necessarily results in the cutting edge in the hemispherical end having a polygonal course, which is undesirable because it results in the milled surface being polygonal as well instead of cylindrical. Apart from that, the interruption of the grinding process while moving from the shaft portion to the hemispherical end portion causes a ridge that prevents formation of a smooth continuity of the cutting edge.

Peripheral milling cutters with better contours are produced by means of grinding with templates which in fact result in a more or less ideal cutting edge. However, with this type of grinding, precision leaves something to be desired.

Particular difficulties arise when the milling cutter is to have a positive rake in the hemispherical end as well.

THE INVENTION

It is an object of the invention to improve machines of this type so that they can be used to make peripheral and facing cutters whose shaft portion smoothly continues into their hemispherical portion and whose cutting edges are precisely adapted to the ideal hemispherical configuration, facilitating a continuous positive rake.

Briefly, a control unit controls the movements of tools or grinding wheels by controlling the actuators such that without interrupting the tool's movement along its path, the intersection of the rotational axis and the X-Y plane describes roughly the arc of a circle whose concave side faces the hemispherical end of the workpiece and which begins at a transitional plane (Y-Z plane) that intersects the X-Y plane at a right angle and lies in the transitional zone toward said hemispherical end. With such a machine, peripheral or die milling cutters can be made with cutting tolerances of about 0,01 mm. Such close tolerances not only mean greater precision for the working surfaces of tools made in that fashion, but they also lead to a more even load on the cutting edges, since all cutting edges of tools with several cutting edges are equally high and contribute evenly to the cutting action.

Because in producing milling cutters and similar tools, a disk-shaped cutting tool, for example a cup-type grinding wheel, is guided in the X-Y plane along the arc of a circle, the result is a relatively very simple control program for the required actuators. At the same time, this results in a smooth transition between the course of the cutting edge in the shaft portion and that in the hemispherical portion, since the grinding wheel moves without any interruption in its course, and since the arc-shaped course begins before the grinding point of the cup-type grinding wheel producing the cutting edge is leaving the shaft portion.

On the other hand, due to the arc-shaped path in the X-Y plane, the required correcting-movement along other axes is achieved very simply if the correcting-movement takes place parallel to the W-axis.

If the machine is to make a spiral-grooved tool, it is suitable to provide the clamping device with an additional actuator that turns the workpiece about its longitudial axis to produce its spiral chipping-grooves, while as each groove is produced in the semispherical end, the rotation of the workpiece gradually comes to a standstill as the point of the tool producing the cutting edge approached the longitudinal axis of the workpiece.

Very well suited for cutting chipping-grooves are frustum-shaped grinding wheels of cutters, if the chipping-groove in a correspondingly shaped, still soft blank has to be precut as precisely as possible, so that only little material is removed by subsequent grinding.

If in grinding the frustum-shaped end, the zone across which the grinding wheel removes material from the workpiece is to be enlarged, it is good practice to reduce the radius of the arc of the circle as soon as the point of the tool producing the cutting edge leaves the shaft portion and enters the hemispherical portion.

The grinding of the workpiece can begin at its tip or at its clamping shaft, but beginning at the tip has advantages as far as the removal of the material and the control program are concerned, because when working in this direction, the grinding wheel gradually plunges deeper into the workpiece, since the chipping area in the tip is not very deep.

Figure 1:
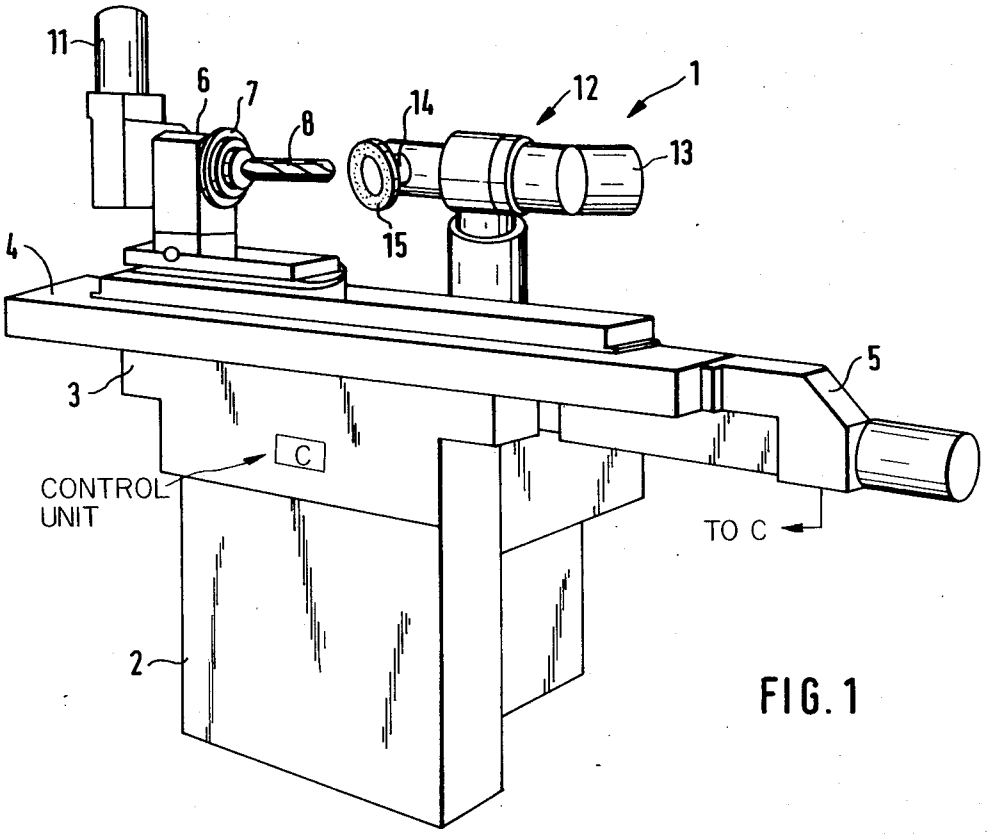
FIG. 1 shows a grinding machine according to the invention, with a clamped-in peripheral milling cutter, in a perspective view.

DETAILED DESCRIPTION:

FIG. 1 shows grinding machine 1 whose purpose it is to cut the surfaces of an elongated peripheral cutting tool which tapers hemispherically at its cutting end. Examples for such tools are peripheral or die milling cutters, etc. Grinding machine 1 carries on a pedestal 2 a roughly horizontal machine bed 3 on which carriage 4 can be moved longitudinally. Carriage 4 is advanced along machine bed 3 by means of screw spindle actuator 5.

Figure 2:
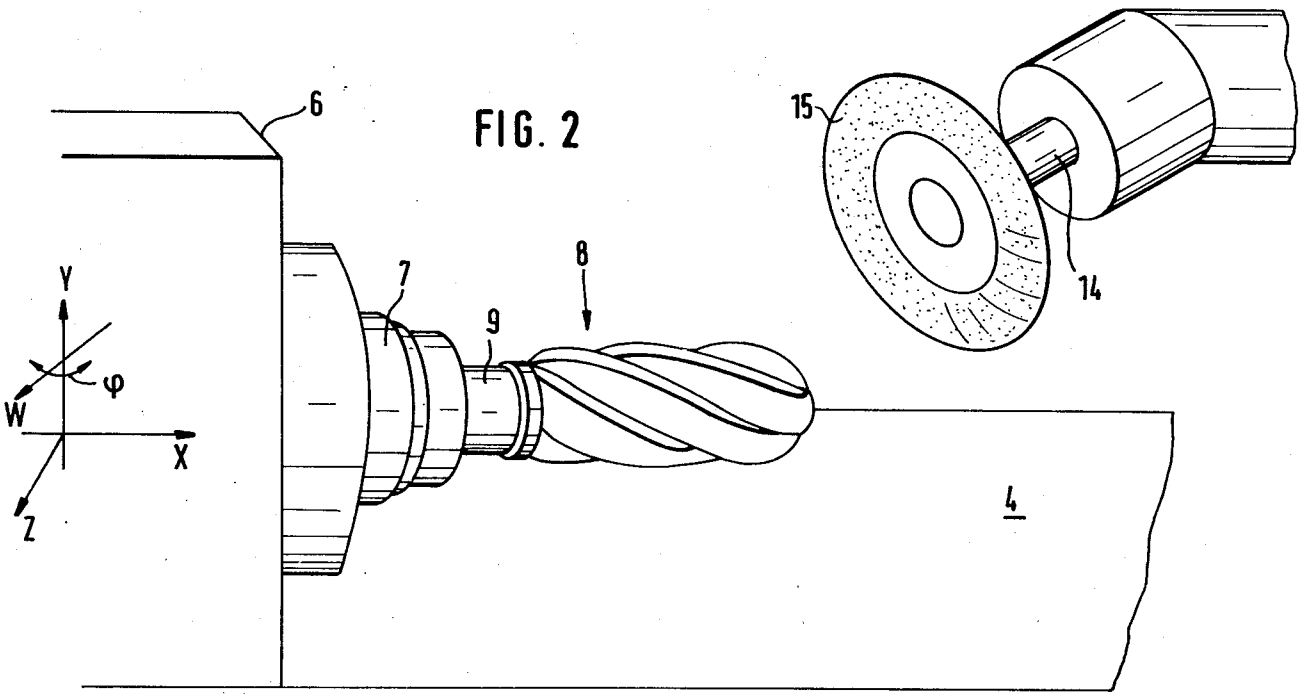
FIG. 2 shows a perspective view of parts of the grinding machine according to FIG. 1, showing detail of the clamped-in peripheral milling cutter with spiral chipping-grooves, and showing detail of the grinding wheel.

Fastened to carriage 4 is workpiece clamping device 6 into whose chuck 7 workpiece 8 is clamped by its stock or shank or shaft 9 (FIG. 2). Chuck 7 of workpiece clamping device 6 is rotatable about its clamping axis which runs parallel to the sliding path of carriage 4 such that workpiece 8 which is clamped in by means of its stock 9 is rotatable about its longitudinal axis which also runs parallel to the sliding path of carriage 4. The rotational movement of chuck 7 is produced by actuator 11 flanged to the clamping device; for this purpose, actuator 11 may be designed, for example, with a stepping motor.

The actuators are controlled by a control unit C. Adjacent to carriage 4, a cutting device 12 contains a grinding spindle 14 that is driven by motor 13 on whose free end a cup-type grinding wheel 15 is rotatably mounted.

By means of carriages, longitudinal guides or pivot bearings not shown, but designed similar to carriage 4, or the bearings of chuck 7, and by means of associated actuators whose design is similar to that of actuators 5 and 11, cutting device 12 can be advanced along at least two axes in relation to workpiece 8. The actuators are controlled via the central control unit C.

The axes along which a relative advance movement between workpiece 8 and grinding machine 15 is possible, are based on a three-dimensional cartesian coordinate system shown in FIG. 2 (left), where the three unit vectors of the coordinate system are mutually perpendicular. This coordinate system relates to workpiece 8 and is oriented such that its X-axis runs parallel to the longitudinal axis of workpiece 8, i.e. parallel to the advance path of carriage 4, while its Y-axis is vertically oriented. The Z-axis of the coordinate system together with the X-axis defines an X-Y plane that lies parallel to the upper surface of machine bed 3, i.e. horizontally.

In the thus defined and oriented coordinate system, carriage 4 permits an advance movement between workpiece 8 and grinding machine 15 along the X-axis which coincides with the longitudinal axis of workpiece 8. Actuator 11 allows the rotational movement of workpiece 8 about the X-axis, where the coordinate system is to remain stationary, while during an advance movement parallel to the X-axis, it moves along with the workpiece, which simplifies the following description of the path movements.

The frusto-shaped grinding machine 15, rotatably driven by and mounted on cutting device 12, can be moved up and down by means of an appropriate actuator, i.e. parallel to the Y-axis (FIG. 2).

The rotational axis of grinding wheel 15 runs rectangularly to the Y-axis, but parallel to the horizontal plane defined by the X- and Z-axes. This rotational axis of grinding wheel 15 forms the W-axis, along which another advance movement is possible by means of actuators. The angle enclosed by the W-axis and the Z-axis in the X-Z-plane, i.e. angle $\phi$, represents the pivoting angle at which a plane intersecting the W-axis at a right angle in turn intersects the X-axis.

The path of the curve that runs through grinding wheel 15 during grinding of the chipping-groove is explained below with the aid of FIGS. 3–5, and the above definition of the axes applies to it as well. For further simplification, it is assumed first of all that workpiece 8 is a straight-grooved milling cutter that has two diametrically opposite chipping-grooves 17 and 18 whose cross-section is a sector of a small ellipse as produced by a frustum-shaped grinding wheel slightly askew in terms of its longitudinal movement. A side wall of chip removal groove or flute 17 or 18, i.e. side wall 19 or 19' (FIG. 3), forms the chipping-surface which is slanted, forms a positive rake and turns into a peripheral flank 22 or 22' at cutting edge 21 or 21'; both flanks 22 and 22' recede from the diameter formed by the two cutting edges 21, 21', starting at cutting edge 21, 21', and increasingly the more distant they are from cutting edge 21 or 21' in the direction of milling cutter 8.

Figure 3:
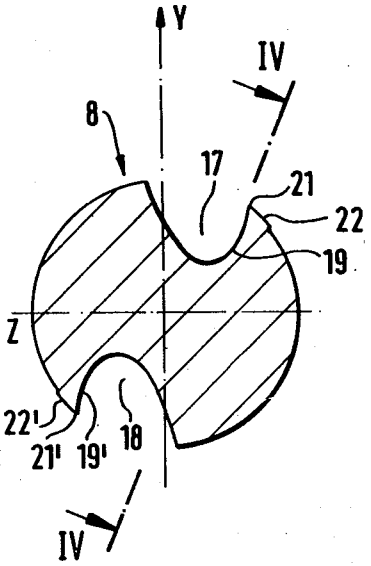
FIG. 3 shows a cross-section of a straight-grooved peripheral milling cutter with two cutting edges, seen along line III—III in FIG. 4.

Since the explanation is based on a peripheral milling cutter 8 with straight grooves, cutting edge 21, 21' and chipping-grooves or flutes 17, 18 run parallel to the longitudinal axis, i.e. to the X-axis which in the plane drawn in FIG. 3, where milling cutter 8 is shown in cross-section, is a axis perpendicular to the plane of the drawing.

Figure 4:
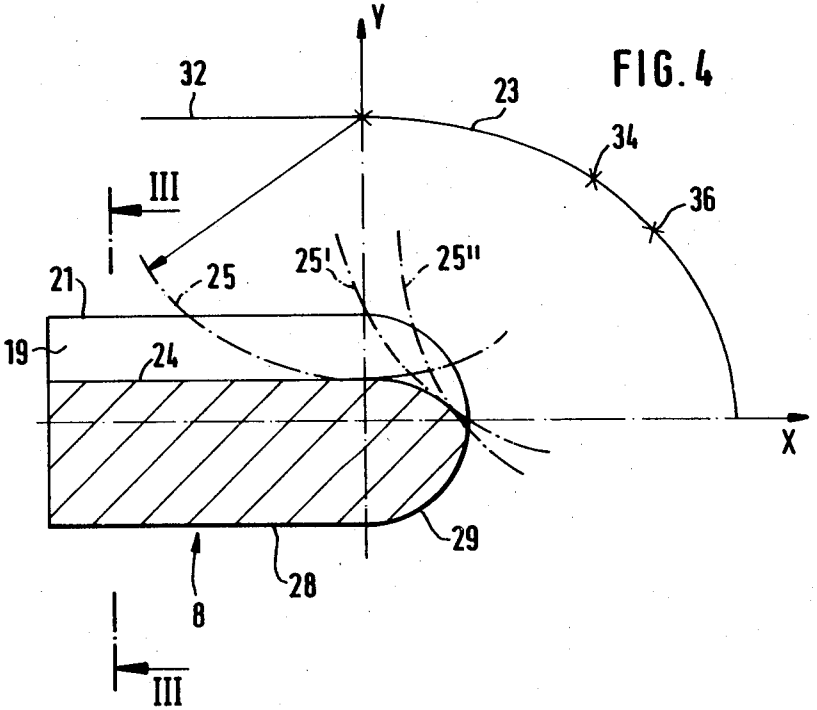
FIG. 4 shows the movement path of the center of the grinding wheel in the X-Y plane in relation to a longitudinal section of the straight-grooved peripheral milling cutter according to FIG. 3, seen along line IV—IV of FIG. 3.

FIG. 4 shows a curve of path 23 of the W-axis in the X-Y plane, and also in this plane is shown a longitudinal section through workpiece 8. As FIG. 3 shows, peripheral milling cutter 8 is drawn approximately in such a way that the cross-section runs through the lowest point of chipping-groove 17. Accordingly line 24 in FIG. 4 shows a core line of milling cutter 8.

FIG. 4 also contains a projection of grinding wheel 15 into the X-Y plane. The projection of grinding wheel 15 in the X-Y plane is shown in part by dotted line 25. Dotted line 25 also represents outer circular cutting edge 27 of grinding wheel 15 which grinds cutting edge 21.

Figure 5:
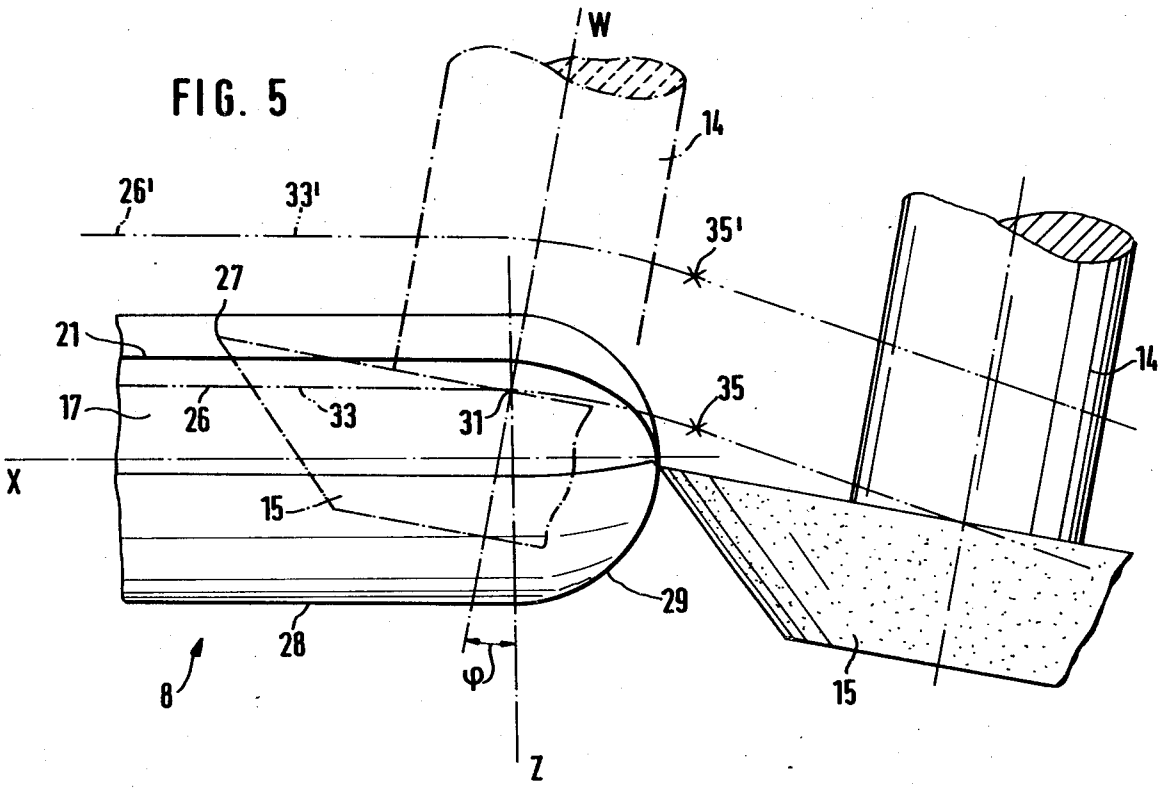
FIG. 5 shows the movement path of the grinding wheel in the X-W plane, in relation to the top view of the peripheral milling cutter shown in FIG. 3.

FIG. 5 shows the projection of peripheral milling cutter 8 and of grinding wheel 15 into the X-Z plane or the X-W plane, and a path curve 26 that describes a point 31 on the W-axis, namely the point where the W-axis intersects a theoretical plane which contains cutting edge 27 of grinding wheel 15 that corresponds to projection 25.

Finally, the peripheral milling cutter lies in the X-Y-Z coordinate system such that the Y-Z plane lies at the place where cylindrical portion 28 of peripheral milling cutter 8 becomes the hemispherical end 29.

The grinding process for the clamped-in workpiece is achieved as follows: First the pivoting angle $\phi$ is determined, i.e. the angle that is enclosed by the W-axis—which coincides with the rotational axis of grinding spindle 14 and the Z-axis in the X-Z plane. Then grinding spindle 14 is moved parallel to the W-axis until the required lateral shift is reached between grinding wheel 15 and workpiece 8. This lateral shift in combination with pivoting angle $\phi$ is necessary, so that chipping surface 19 has the desired positive rake. How the pivoting angle and the lateral shift are determined for the grinding of cutting edges in cylindrical workpieces is a known procedure and does not require explanation in detail.

When that setting has been made, the grinding wheel is plunged into workpiece 8 along the Y-axis near clamping shaft 9 while grinding spindle 14 is activated at the same time. As soon as the required plunging depth is reached, the actuator that advances grinding wheel 15 along the Y-axis is stopped, and instead the actuator that moves grinding wheel 15 along the X-axis in relation to workpiece 8 is started. In the embodiment described, actuator 5 is turned on and moves clamping device 6 together with workpiece 8 away from grinding wheel 15, i.e. in FIGS. 4 and 5 to the left. Grinding wheel 15 then produces chipping-groove 17 in cylindrical portion 28, while intersection 31 on the W-axis at first moves along straight sector 32 of path curve 23 in the X-Y plane. Simultaneously, as point 31 moves along path sector 32 (FIG. 4) on the W-axis, it moves along path curve 26, (FIG. 5) coming from the left, on straight sector 33 of curve 26. For the sake of clarity, path curve 26 has been shifted to a parallel position, drawn again and identified by reference number 26', while straight sector 33 is shown as 33'. The straight course of both path curves 26 and 23 ends at the Y-Z plane which represents the transition between cylindrical portion 28 and hemispherical end 29 of peripheral milling cutter 8. When point 31 reaches the Y-Z plane on the W-axis, grinding wheel 15 and grinding spindle 14 are at a relative position to peripheral milling cutter 8, as shown by the dotted lines in FIG. 5. The associated projection of cutting edge 27 is shown by chain-dotted line 25 in FIG. 4. After the X-Y plane, point 31 does not move in a straight line, neither in the X-Z plane nor in the X-Y plane. In the X-Y plane, after the Y-axis, point 31 moves through the arc of a circle whose radius at which core line 24 curves toward the longitudinal axis of peripheral milling cutter 8. Thus path curve 23 can be conceived as an epicycloid which is described by the center of grinding wheel 15 as it rolls off through chipping-groove 17.

When the W-axis, i.e. the rotational axis of grinding wheel 15, begins to move along the arc of a circle in the X-Y plane, the grinding point, i.e. the point where cutting edge 27 intersects cutting edge 21 of peripheral milling cutter 8, still lies in cylindrical portion 28. It is therefore necessary for grinding wheel 15 to be advanced along the W-axis by starting the appropriate actuator, so that cutting edge 27 approaches the longitudinal axis of peripheral milling cutter 8. Grinding wheel 15 thus performs a correcting movement in the X-Z plane along the W-axis such that cutting edge 21 represents a smooth continuation of the original course in the newly produced portion, even when the rotational axis of grinding wheel 15 is lowered.

As soon as the above mentioned grinding point has left cylindrical portion 28 and runs through the X-Z plane, point 31 on the W-axis reaches a point 34 on the path curve. Cutting edge 27 is then situated at a plane that is shown in FIG. 4 as line 25'. On path curve 26 or 26', point 31 has moved up to place 35 or 35'. After this place 35, path curve 26 runs almost in a straight line, while the angle at which it intersects the X-axis, is chosen such that cutting edge 21 produced by cutting edge 27 adapts to an imaginary hemisphere in the hemispherical portion 29, while point 31 in the X-Y plane continues to run through arc-shaped path curve 23 in the direction of the X-axis.

When point 31 on path curve 23 has moved from place 34 to place 36, the projection of cutting edge 27 runs in the X-Y plane, as shown by chair-dotted line 25''. In this relative position between grinding wheel 15 and peripheral milling cutter 8, core line 24 has been completely ground even in the end portion, i.e. where it intersects the longitudinal axis of peripheral milling cutter 8, and it is possible now to continue path curve 23 with an arc of lesser radius and thus to improve the engagement between grinding wheel 15 and workpiece 8. The radius of path curve 23 between point 36 and the X-axis is about equal to the radius of cutting edge 27, with the center of the circle lying in the tip of peripheral milling cutter 8. To avoid producing a visible area of discontinuity in the transition between the two radii of curvature of path curve 23, it can be an advantage to gradually reduce the radius of curvature between points 34 of path curve 23 from the first larger to the second smaller radius.

During the entire grinding process, the pivoting angle $\phi$ is held constant, while on the other hand geometrically relatively simple path curves are obtained.

Although for the purpose of clarity and simpler explanation of path curves 23 and 26 it is assumed that the grinding of peripheral milling cutter 8 takes place from its clamping shaft or shank 9 to its hemispherical end 29, it is more practical to work in the opposite direction, i.e. from tip 29 toward clamping shaft 9, because in that case plunge of grinding wheel 15 to the fullest extent can be avoided. In the latter direction, grinding wheel 15 plunges into the workpiece gradually because core line 24 recedes in relation to the outer contour.

Furthermore, in an effort not to unnecessarily complicate the description of the relative movement between grinding wheel 15 and workpiece 8, it was assumed that the workpiece has straight grooves or plates. Of course, workpieces with spiral flutes or grooves can be produced as well, where path curves 23 and 26 take the same course in principle. To produce workpieces with spiral grooves it is only necessary to turn workpiece 8 gradually about its longitudinal axis by means of actuator 11 at the same rate at which grinding wheel 15 is advanced along the X-axis; the pivoting angle $\phi$ has to be enlarged accordingly.

As soon as with a spiral-grooved workpiece 8 the grinding wheel begins to grind chipping-groove 17 in the hemispherical tip 29, the speed at which actuator 11 rotates workpiece 8 about its longitudinal axis is gradually reduced to zero without any change in the described course of path curves 23 and 26. Preferably the pivoting of workpiece 8 should come to a standstill when point 31 passes path curve 23 in the sector between point 36 and the X-axis. In that case, the concave side of path curve 23 faces workpiece 8.

The actuators or servo-drives can be of any suitable type such as stepping motors or position-controlled A.C. or D.C. motors.

I claim:

1. Machine for cutting a cutting end and chipping-grooves, particularly into workpieces (18) forming elongated peripheral cutting tools such as milling cutters, die cutters, and the like, having a shank portion (9) and a cutting end which defines an essentially hemispherical end portion (29)

comprising a cutting machine (1) having a machine bed (3);

a clamping device (6) for clamping the shank portion (9) of the workpiece, mounted on the machine bed;

a rotatably driven cutting device (12);

a rotatably driven disk-shaped cutting tool (15) on the cutting device;

a plurality of actuators (5,11,13) coupled, respectively, to the cutting tool (15) and the clamping device (6) for relative movement, adjustable in a coordinate system related to the workpiece (8), wherein the coordinate system is defined by an X-axis which contains the longitudinal axis of the workpiece (8), a Y-axis which extends orthogonally to the X-axis, and a Z-axis which extends at right angles to the X and Y-axes;

and a control unit (C) coupled to and controlling the movement of the actuators, wherein, in accordance with the invention, the control unit controls relative movement of the cutting tool (15) and of the clamping device (6) and hence the workpiece (8) by controlling the respective actuators (5, 11), said cutting tool being moved by the respective actuator (13) in a direction parallel to a W-axis, wherein said W-axis is determined by an axis which intersects an X-Y plane defined by the X-axis and the Y-axis at an angle ($\phi$), which angle represents the pivoting angle of the cutting tool, and wherein the projection of the W-axis unto the X-Y plane extends parallel to the X-axis;

said control unit further controlling said relative movement of said actuators, continuously and without interruption, to move an intersection (31) of the axis of rotation of the cutting tool with the X-Y plane to describe, approximately, a part circle (23) having the concave sides thereof facing the hemispherical end portion (29) of the workpiece (8), said part circle (23) beginning at a transition plane which intersects the X-Y plane at right angles, and defines a Y-Z plane, and positioned at the transition between the shank portion (9) and the essentially hemispherical end portion (29) of the workpiece; and wherein said control unit further controls, simultaneously, movement, during passage of the cutting tool through said part circle (23), feed of the cutting tool parallel to the W-axis and towards the longitudinal axis of the workpiece (8), so that a finished cutting edge (21) on the workpiece (8) will smoothly continue between the transition plane (Y-Z) and the end portion of said workpiece.

to provide a positive rake of the cutting edge in the direction of the longitudinal axis starting from the transitional plane towards the hemispherical portion (29) of the chipping groove cut by said cutting tool.

2. Machine according to claim 1, wherein to produce spiral chipping-grooves, one (11) of the actuators for the clamping device (6) is coupled to turn the workpiece (8) about its longitudinal axis (X) for cutting spiral chipping-grooves (17, 18), and wherein to produce each chipping-groove (17, 18) in the hemispherical end (29), the control unit (C) controls rotation of the workpiece (8) about its longitudinal axis to a gradual standstill as the point of the cutting tool (15) producing the cutting edge (21) approaches the longitudinal axis of the workpiece (8).

3. Machine according to claim 1, wherein the cutting tool comprises an essentially frustum-shaped grinding wheel (15).

4. Machine according to claim 1, wherein the pivoting angle ($\phi$) of the tool (15) is held constant throughout the cutting operation.

5. Machine according to claim 1, wherein the control unit (C) controls the radius of the arc or circular path of the part circle to be reduced when the relative movement of the cutting tool (15) producing the cutting edge (21) and the workpiece has placed the cutting tool into the hemispherical end (29).

6. Machine according to claim 1, wherein during the cutting process the actuators relatively move the workpiece (8) and the cutting tool from a starting position adjacent the hemispherical end (29) toward the shank (9).

7. Machine according to claim 1, wherein the machine comprises a grinding machine, and the cutting tool comprises an essentially frustum-shape grinding wheel.

8. Method of cutting a hemispherical cutting end and chipping-grooves into a workpiece (8), particularly for forming elongated peripheral cutting tools such as milling cutters, die cutters, and the like, having a shank portion (9) and a cutting end which defines an essentially hemispherical end portion (29)

utilizing a cutting machine (1) having a machine bed (3);

a clamping device (6) for clamping the shank portion (9) of the workpiece, mounted on the machine bed;

a rotatably driven cutting device (12);

a rotatably driven disk-shaped cutting tool (15) on the cutting device;

a plurality of actuators (5,11,13) coupled, respectively, to the cutting tool (15) and the clamping device (6) for relative movement, adjustable in a coordinate system related to the workpiece (8), wherein the coordinate system is defined by an X-axis which contains the longitudinal axis of the workpiece (8), a Y-axis which extends orthogonally to the X-axis, and a Z-axis which extends at right angles to the X and Y-axes;

comprising the steps of defining a W axis by an axis which intersects an X-Y plane defined by the X-axis and the Y-axis at an angle ($\phi$), which angle represents the pivoting angle of the cutting tool, and wherein the projection of the W-axis unto the X-Y plane extends parallel to the X-axis;

moving, without interruption and continuously, the cutting tool (15) such that the intersection (31) of the axis of rotation with the X-Y plane defines essentially a part circle (23), the concave side of which faces the essentially hemispherical end portion (29) of the workpiece, and which starts at a transition plane (Y-Z) which interesects the X-Y plane at a right angle and which is located at the transition to the essentially hemispherical end (29) of the workpiece, and simultaneously controlling the cutting tool (15) while it passes through said circular path (23) to feed the cutting tool parallel to the W-axis and towards the longitudinal axis of the workpiece (8) to form a finished cutting edge (21) which will smoothly continue between the transition plane (Y-Z) and the end portion of said cutting tool, and to provide a positive rake of the cutting edge in the direction of the longitudinal axis starting from the transitional plane towards the hemispherical portion (29) of the chipping groove cut by said cutting tool.

9. Method according to claim 8, wherein, to form spiraled grooves, in space, the method further includes the step of rotating the workpiece (8) about its longitudinal axis;

and slowly terminating the rotation of the workpiece about its longitudinal axis upon generation of the respective groove (17, 18) in the essentially hemispherical end portion (29), in coordination with the movement of the cutting tool generating the cutting edge (21) as the cutting edge approaches the longitudinal axis of the workpiece.

10. Method according to claim 18, including the step of decreasing the radius of the arc or circular path of the part circle when the relative movement of the cutting tool (15) producing the cutting edge (21) and the workpiece has placed the cutting tool into the hemispherical end (29).

11. Method according to claim 8, including the step of maintaining constant throughout the operation the pivoting angle ($\phi$) of cutting tool (15).

12. Method according to claim 8, wherein the step of controlling movement of the cutting tool (15) ongitudinally with respect to the workpiece comprises relatively moving the workpiece (8) and the cutting tool from a starting position adjacent the hemispherical end (29) toward the shank (9).

13. Method according to claim 8, wherein the cutting tool comprises an essentially frustum-shaped grinding wheel and forming the cutting edge (21) in the workpiece (8) by grinding.

* * * * *